United States Patent [19]

Gibson et al.

[11] 4,015,738

[45] Apr. 5, 1977

[54] MATERIAL-HANDLING APPARATUS

[75] Inventors: Christian D. Gibson; Kenneth F. Hart, both of Greene, N.Y.

[73] Assignee: The Raymond Corporation, Greene, N.Y.

[22] Filed: Apr. 13, 1976

[21] Appl. No.: 676,564

Related U.S. Application Data

[63] Continuation of Ser. No. 443,952, Feb. 20, 1974, abandoned.

[52] U.S. Cl. ..... 214/674; 187/9 R

[51] Int. Cl.[2] ..... B66F 9/20

[58] Field of Search ..... 214/660, 670–674; 180/11, 14 R, 70 R, 6.5, 65 R; 248/2, 16; 187/291, 9 R

[56] References Cited

UNITED STATES PATENTS

| | | | |
|---|---|---|---|
| 1,997,490 | 4/1935 | Hoar | 211/89 |
| 3,098,574 | 7/1963 | DeMarco | 214/674 |
| 3,376,990 | 4/1968 | Latall | 214/671 |
| 3,378,159 | 4/1968 | Trusock | 214/672 |
| 3,414,086 | 12/1968 | Ulinski | 187/9 E |

*Primary Examiner*—Robert J. Spar
*Assistant Examiner*—Lawrence J. Oresky
*Attorney, Agent, or Firm*—Richard G. Stephens

[57] ABSTRACT

A counterbalanced lift truck mast is adjustable to a plurality of discrete different longitudinal positions between the truck load bearing wheels to overcome additional counterweighting requirements or load derating if various load manipulators position the load at varying distances from the load wheels. The load bearing wheels are driven through separate very narrow gear train housings to provide adequate space for mast adjustment.

18 Claims, 17 Drawing Figures

MATERIAL-HANDLING APPARATUS

Figure 1A:
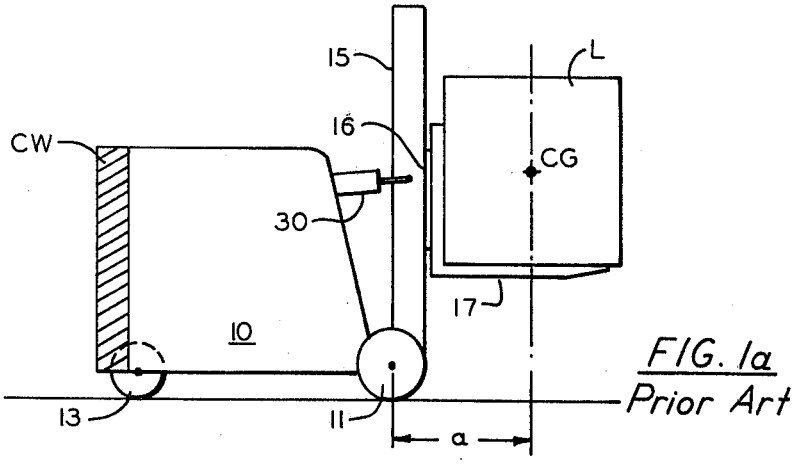
FIG. 1a Prior Art

This application is a continuation of my prior copending application Ser. No. 443,952 filed Feb. 20, 1974 now abandoned.

In counterbalanced types of lift trucks, the truck base frame is supported near its front end by a pair of load wheels, and a mast situated near the front end of base frame carries an elevatable load carriage carrying forks or the like which can support a load in cantilever fashion, with the load center-of-gravity ordinarily in front of the load wheels. The location of the load ahead of the load wheel drive axle or load wheel centers provides a load moment tending to rotate the truck front end downwardly. That downward pitching moment is opposed or counterbalanced by the weights of the truck base frame, battery or engine compartment and operator station, plus an added counterweight, all located on the rear side of the load wheels so as to provide an upward pitching moment. Safe operation requires that the upward pitching moment always exceed the downward pitching moment imposed by the load, with some safety factor in order that the truck not pitch front end downwardly and overturn. The downward pitching moment is not only a function of the weight of the load but also the distance of the center-of-gravity of the load from the load wheel axle, or center of rotation. Good engineering practice dictates that that distance be minimized as much as possible, and trucks are carefully designed with these considerations in mind.

A problem arises in the design of such trucks when various special devices must be employed, such as triple-section or quadruple-section masts, side-shifting mechanisms, load clamps, load roll-over devices. The installation of such a device has increased the downward pitching moment, not only because of the added weight of such a device, but, perhaps more importantly, because the longitudinal space occupied by such a device has required that the load be carried a greater distance ahead of the load wheel axles. Consequently in order to maintain the stability of a counterbalanced truck when such a device has been installed, it has been necessary in the prior art either to drastically reduce the amount of payload which may be carried, or additional counterweight has been required. One object of the present invention is to provide a basic lift truck wherein the distance from load axle to load center-of-gravity may be maintained substantially constant, regardless of the longitudinal thickness of the special device which may be added to the carriage, and regardless of the longitudinal thickness of the mast. This object is accomplished, as will be seen below, by provision of a novel mast-mounting arrangement which allows the mast to be mounted on the truck frame at any one of a plurality of discrete longitudinal positions. By use of such a mast mounting arrangement, one may select a longitudinal mast position so as to compensate for the thickness of the various special devices which may be used. Thus a given truck may be outfitted with a given one or more of the special devices, with no need to de-rate the truck to limit its use to smaller payloads, and no need to use additional counterweight. The ability to so use a given truck with a number of different special devices will be seen to offer significant economy, eliminating the need to design and manufacture a different truck for each set of special devices or attachments which may be used. Also, if one desires to alter a truck in the field to incorporate a different attachment, one may readily do so, without de-rating its payload capacity or having to add counterweight. When a load-carrying attachment which holds a load with its center-of-gravity say 24 inches forward of the mast is substituted for a prior attachment which holds its load with its center-of-gravity 20 inches forward of the mast, the mast may be moved approximately four inches rearwardly on the truck, thereby allowing the same maximum load to be carried, and without the need for added counterweight, assuming the carriage weight is the same.

In most counterbalanced lift trucks the lateral width of the load carriage exceeds the lateral spacing of the front wheels, and in such trucks the minimum load moment arm which one can achieve is limited by the diameter of those wheels, since the carriage must be sufficiently forward to clear the wheels in order to fully lower the carriage. In trucks using a narrower carriage which can fit between the wheels, use of the invention allows one to mount the mast sufficiently rearwardly that extremely small load moment arm distances may be achieved. In various forms of reach truck, the truck mast is slidably arranged so that it can be extended forwardly to pick up a load, and then retracted to locate the center-of-gravity of the load within the wheel base of the truck while the truck is traveling. The front wheels of such a truck are carried on a pair of legs which extend appreciably forwardly from the base frame of the truck, ordinarily at the lateral extremities of the truck. In order to retract the load, sufficient space must be provided between the legs, and hence the lateral distance between the legs limits the width of the load which may be handled. It is frequently deemed desirable that the front wheels supporting the legs be the powered or driven wheels of the truck, in order to improve traction. Various arrangements which have been proposed for driving the wheels on the truck legs have been unsatisfactory because they require legs of undesirable width so that an electric drive motor can be installed within each leg, as in British Pat. No. 1,273,555, for example. A system disclosed in British Pat. No. 1,092,281 uses an hydraulic motor within each leg, which can allow some decrease in the size of each leg, but which has the disadvantage of requiring hydraulic rather than all-electric control. Thus another object of the invention is to provide improved power transmission means for connecting the drive wheels which are located forwardly from the truck base frame to be powered by electric motors, with such means being substantially laterally thinner than the power transmission means heretofore proposed, but capable of providing powerful and reliable power transmission.

Because the mast in most trucks carries large loads, it is vitally important that it be firmly fixed in place on the truck frame, and another object of the invention is to provide an improved mast-mounting arrangement having adequate strength even though the mast may be positioned at any one of a plurality of discrete longitudinal positions.

Provision of a mast mounting arrangement which allows the mast to be mounted in any one of a plurality of longitudinal positions, without increasing the length of the truck is complicated by the fact that insufficient space has been available in prior art counterbalanced trucks to allow such an arrangement. Such trucks ordinarily have included a drive axle and differential gearing housing which extends between the drive wheels of the truck and occupies the space within which one would want to adjust the mast. In accordance with another concept of the present invention, space within which the mast may be adjustably positioned in the truck longitudinal direction is made available by eliminating the drive axle and differential gearing, so that no fixed structure extends across the truck from one drive wheel to the other. The drive wheels are instead driven by separate gear trains which extend forwardly from motive means on the base frame to each drive wheel. Mounting the motive means on the base frame instead of inside the legs extending from the base frame allows one to significantly decrease the width of the power transmission mechanism. To avoid having to increase the overall truck width, it is necessary that the gear train housings have minimum width. In accordance with a further feature of the invention, novel gear train housings are provided, each of which serves triple functions. Firstly, each gear train housing supports the gears of a gear train to drive one drive wheel. Secondly, each such housing acts as a wheel mounting to support one drive wheel relative to the truck base frame, acting as an extension of a base frame side member. Thirdly, each gear train housing carries a mounting block within which one side of the mast may be selectively positioned. In order that each gear train housing consume minimum lateral space, all of the gears therein are arranged to lie within the same plane, except for an output pinion, which extends inside a drive wheel and therefore does not consume additional lateral space. Other objects of the invention are to provide an improved lift truck power transmission mechanism having such space-saving features.

In its broader aspects, the invention is not limited to trucks in which the mast is arranged to be adjustable to plural longitudinal positions. The invention may be viewed broadly as provision of a power transmission and structural component arrangement in a truck which provides sufficient space for the mast to be installed in, or translated to, a sufficiently rearward position.

It is very frequently desirable that the mast be capable of being tilted slightly, so that forks or the like carrying a load be able to cradle the load, and thus it is another object of the invention to provide a lift truck mast mounting arrangement wherein a mast may be positioned on the truck at any one of a plurality of discrete longitudinal positions in such a manner that the mast may be tilted at any of said positions.

Another object of the invention is to provide a mast mounting arrangement wherein the number of discrete longitudinal positions at which the mast may be located may be increased significantly without a requirement that extra parts such as shims be provided, or that various parts be slidably adjusted relative to each other.

While hydraulic systems are known for translating lift truck masts forwardly and rearwardly on a truck to pick up or deposit loads, the provision of such mast-mounting and translation systems merely to move a mast when a different attachment is substituted would be prohibitively expensive. While various mechanical arrangements conceivably might be devised to allow continuous adjustment of a mast through a given range of longitudinal positions, they tend to have numerous disadvantages, since some means must be provided to insure that both sides of the mast are moved forwardly or rearwardly by equal amounts. Various systems which might employ a variety of substitutable sets of shims are conceivable, but disadvantageous in that such extra parts must be stocked and kept track of. Various other conceivable means which would allow a mast to be positioned to many different longitudinal positions are disadvantageous because they would be incapable of withstanding the considerable forces involved without prohibitive increases or decreases in various dimensions of the truck or its parts. Some further objects of the invention are to provide a lift truck mast mounting arrangement which obviates such problems.

Other objects of the invention will in part be obvious and will in part appear hereinafter.

The invention accordingly comprises the features of construction, combination of elements, and arrangement of parts, which will be exemplified in the constructions hereinafter set forth, and the scope of the invention will be indicated in the claims.

For a fuller understanding of the nature and objects of the invention reference should be had to the following detailed description taken in connection with the accompanying drawings, in which:

FIG. 1*a* is a diagrammatic side view of a typical counterbalanced lift truck having load forks extending from its load carriage.

Figure 1B:
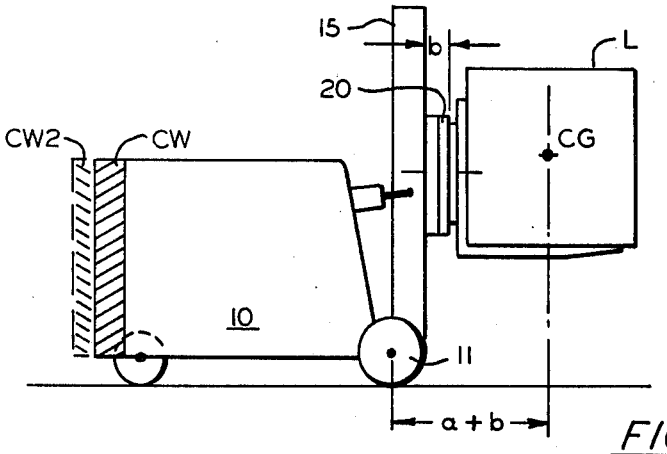

FIG. 1*b* is a diagrammatic side view similar to FIG. 1*a* illustrating, by comparison to FIG. 1*a*, the required increase in load moment arm distance when such a truck is equipped with a load-rotating mechanism.

Figure 1C:
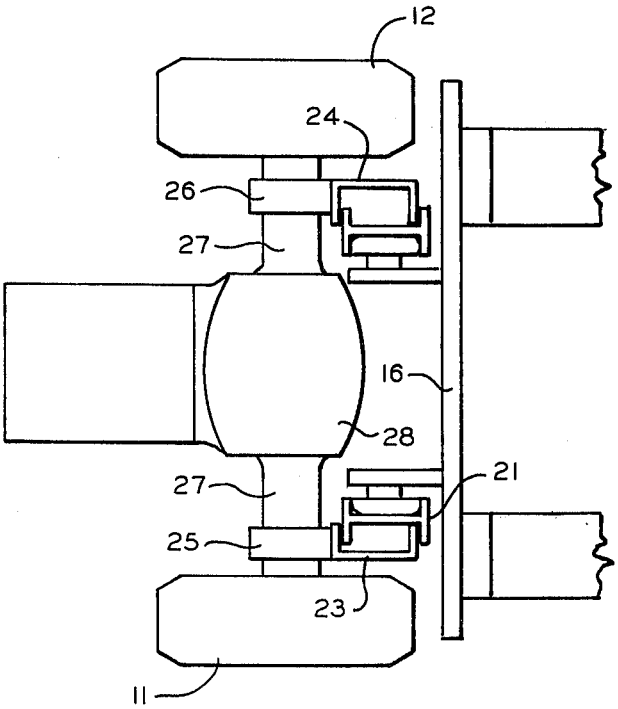

FIG. 1*c* is a diagrammatic plan view of the mast-mounting and drive wheel portions of a typical prior art counterbalanced truck using a conventional two-stage mast.

Figure 1D:
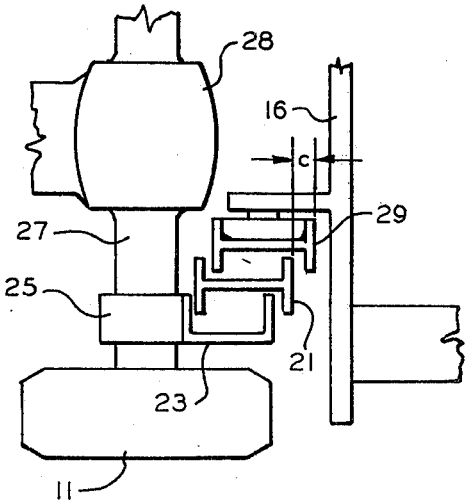

FIG. 1*d* is a fragmentary diagram similar to one-half of FIG. 1*c* illustrating, by comparison to FIG. 1*c*, the required increase in load moment arm distance when such a truck is equipped with a three-stage mast.

Figure 2A:
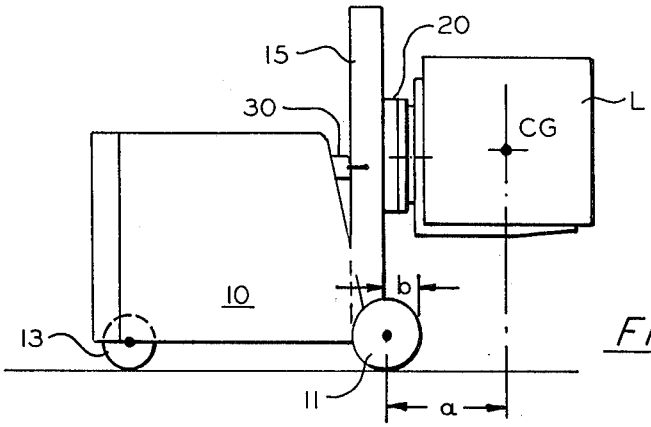

FIG. 2*a* is a diagrammatic side view of a counterbalanced truck constructed in accordance with the invention, and illustrates, by comparison with FIGS. 1*a* and 1*b*, how the truck of the present invention may achieve the reduced load moment arm distance of FIG. 1*a* even when the truck is equipped with a load-rotating device of the type indicated in FIG. 1*b*.

Figure 2B:
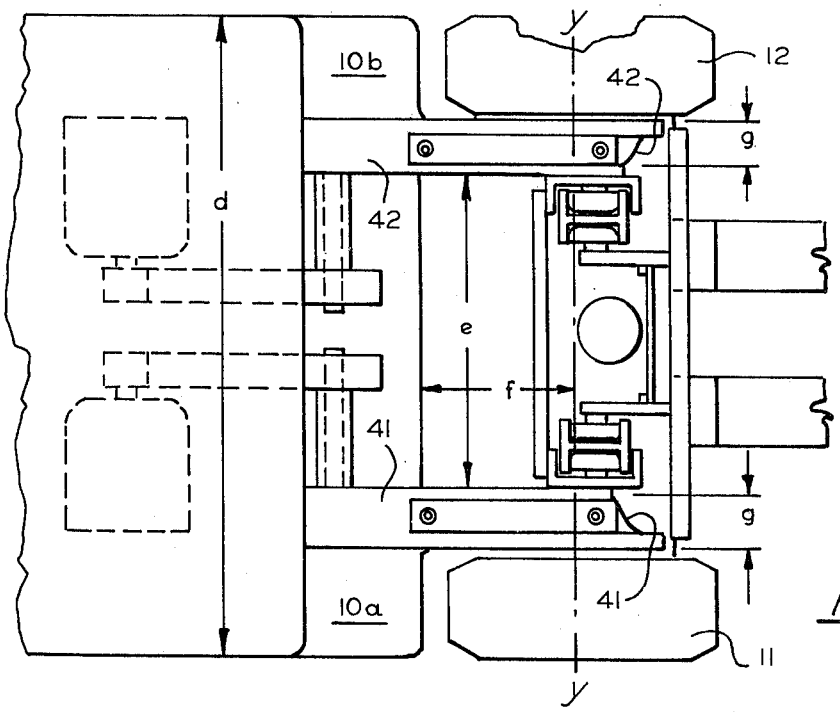

FIG. 2*b* is a diagrammatic plan view generally illustrating the mast-mounting and drive wheel portions of a truck constructed in accordance with the present invention.

Figure 3B:
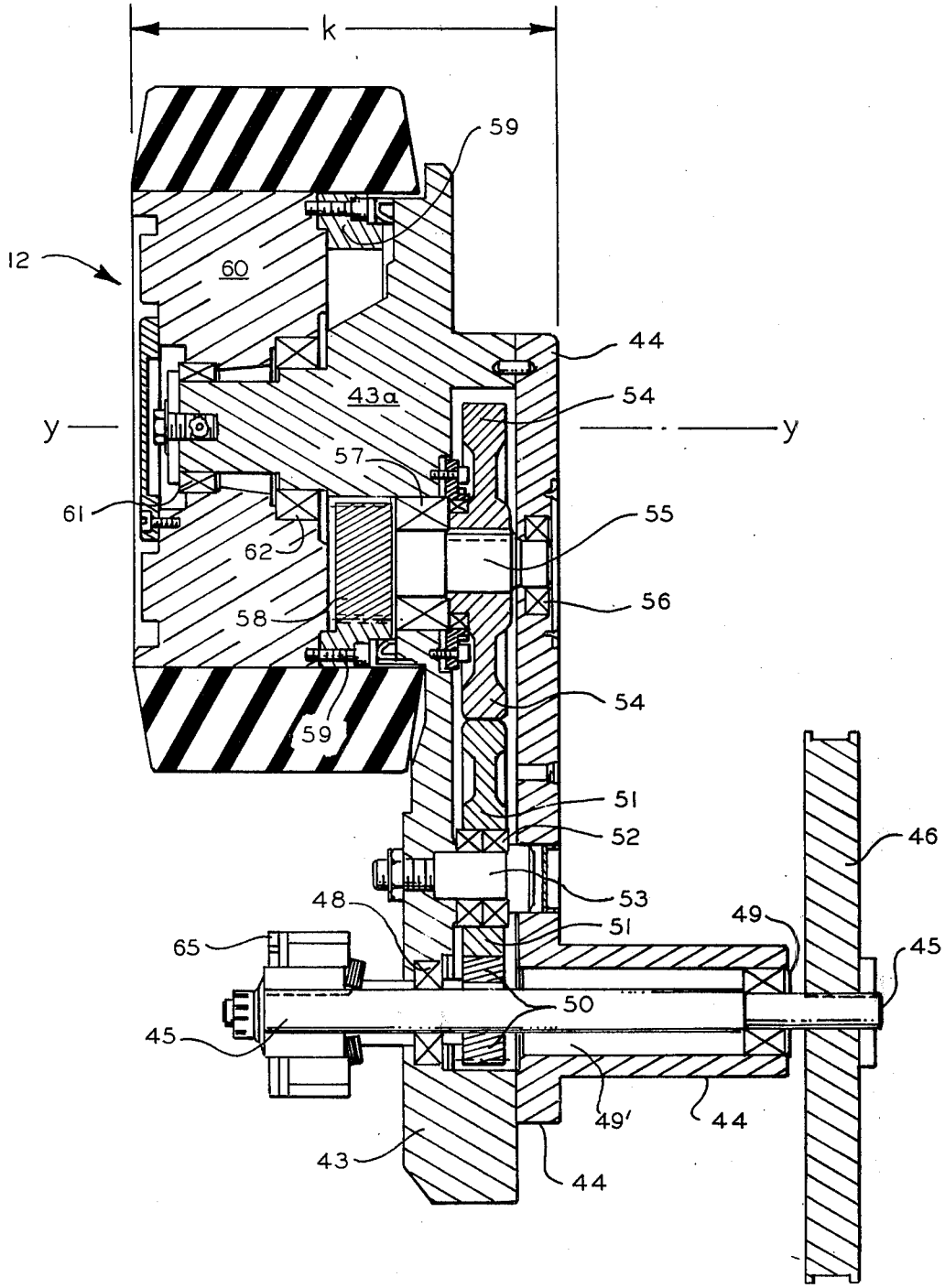
Figure 3A:
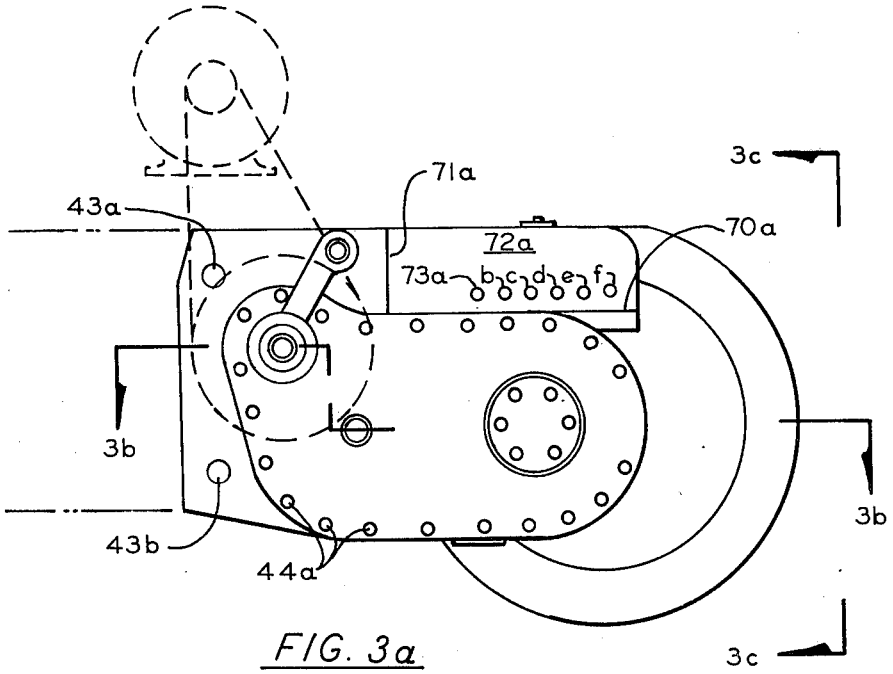
Figure 3C:
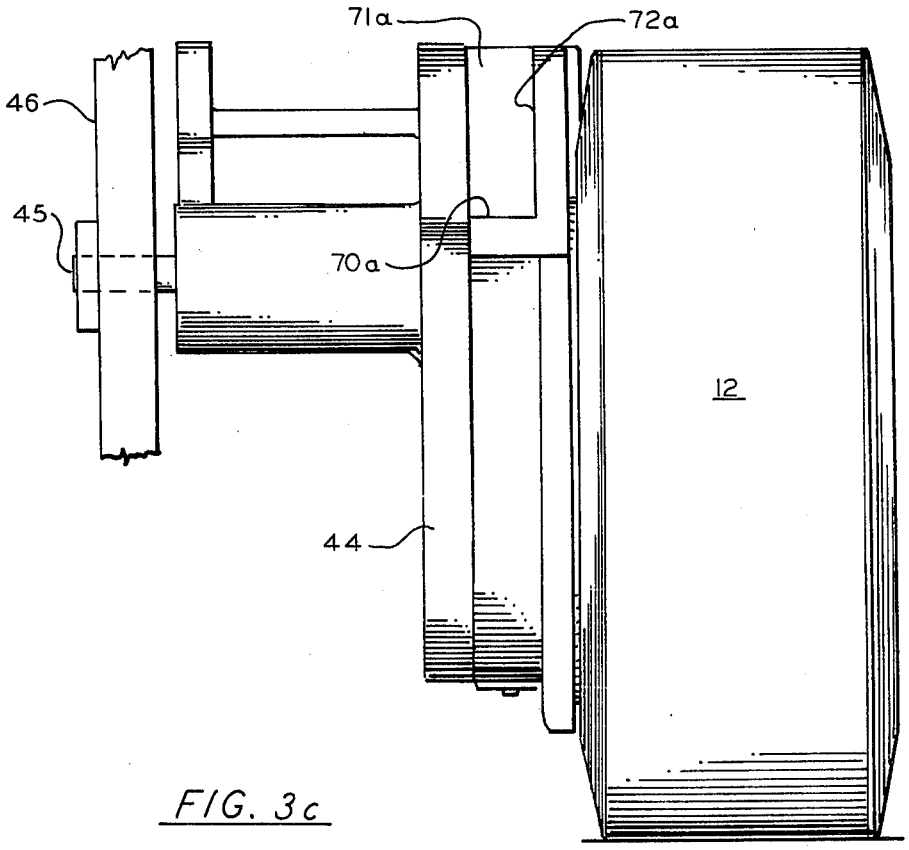

FIG. 3*a* is a side view of one form of gear housing and wheel-mounting assembly constructed in accordance with the invention, FIG. 3*b* is a section view taken at lines 3*b*—3*b* in FIG. 3*a*, and FIG. 3*c* is an end view taken at lines 3*c*—3*c* in FIG. 3*a*.

Figure 4B:
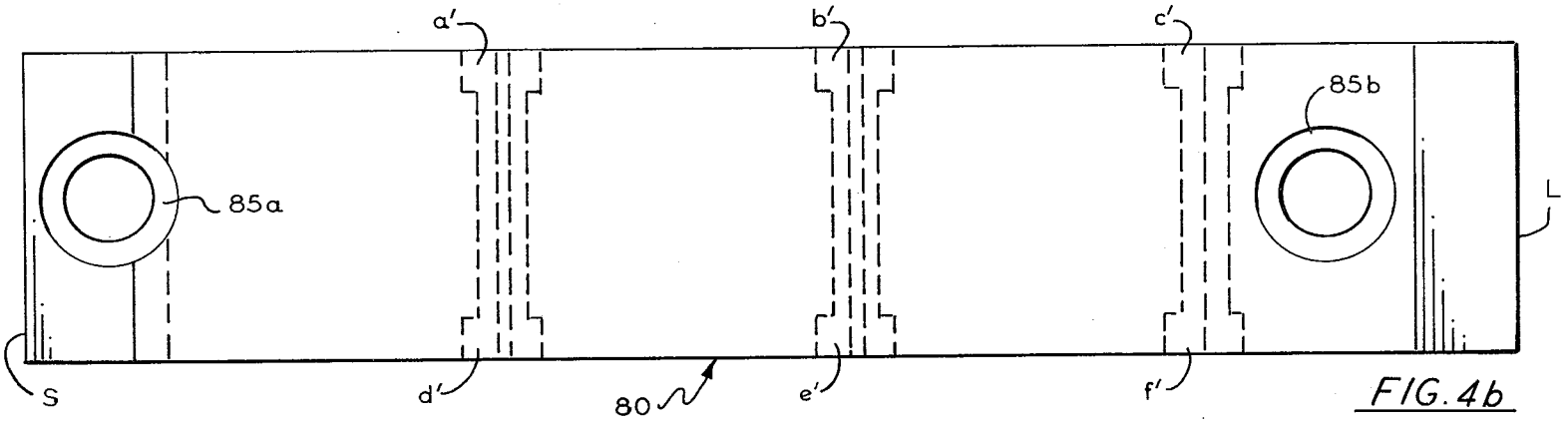
Figure 4A:
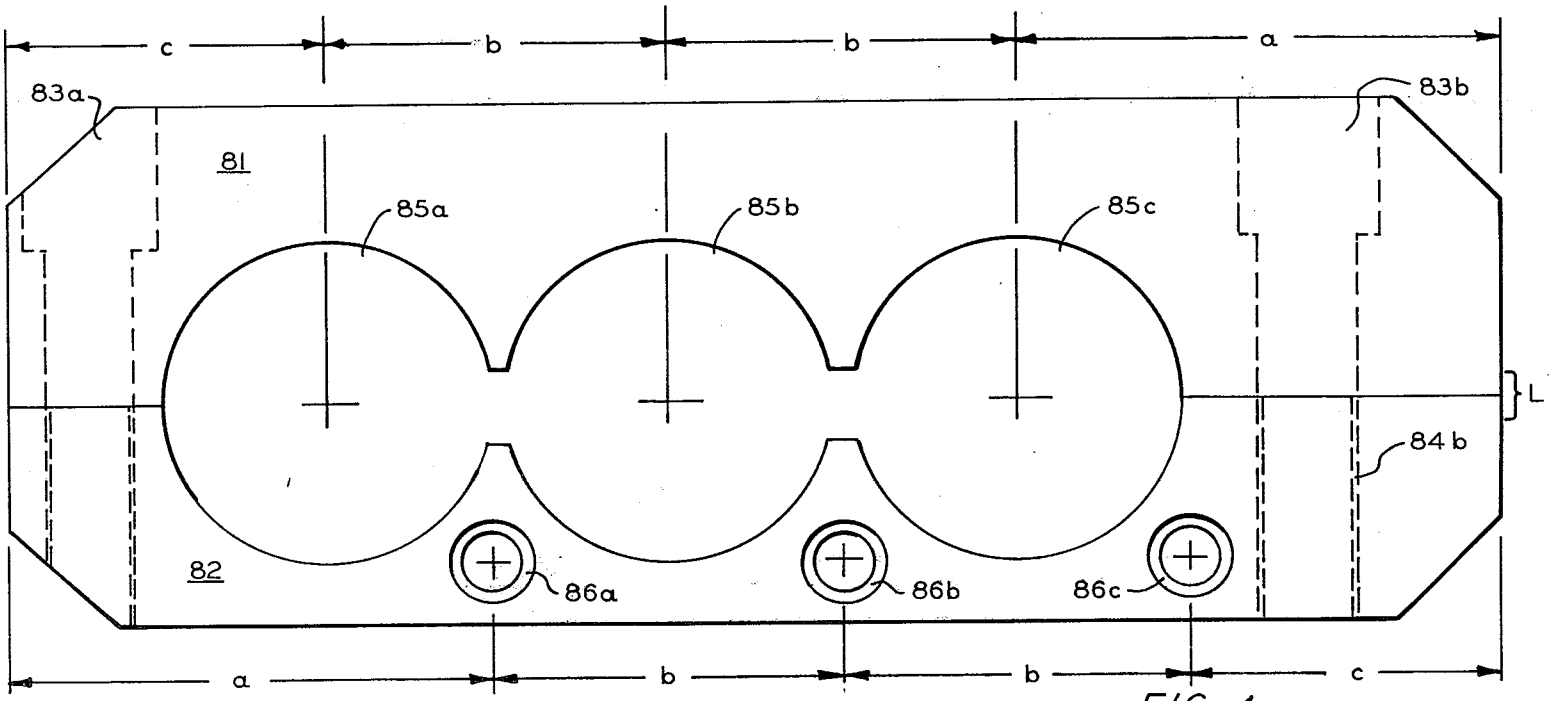

FIGS. 4*a* and 4*b* are side and top views, respectively, of an exemplary mast mounting block portion of the invention.

Figure 4D:
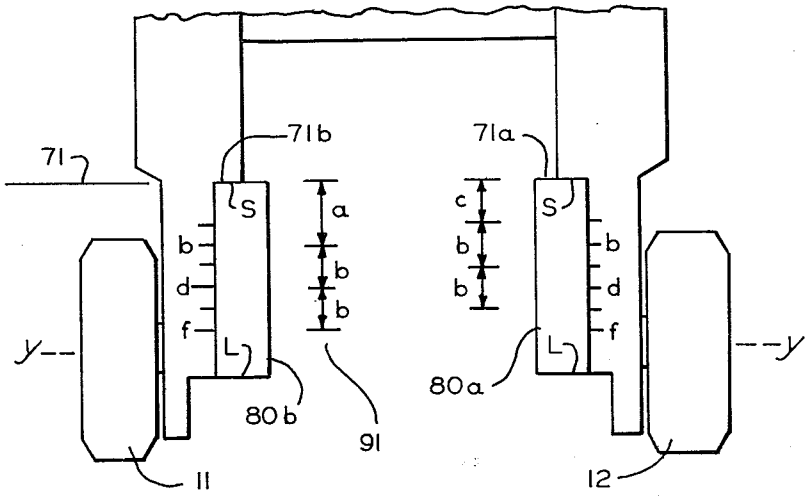
Figure 4C:
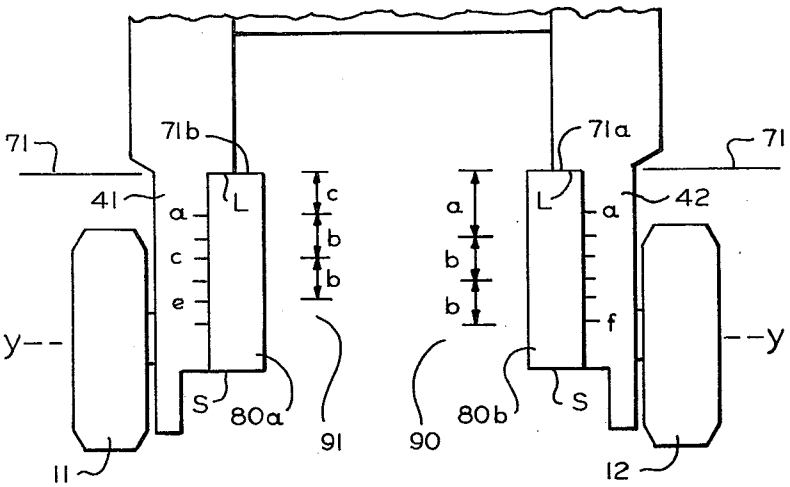

FIGS. 4*c* and 4*d* are diagrams useful in understanding how mounting block portions of the invention may be rotated in order to double the number of available mast positions.

Figure 5C:
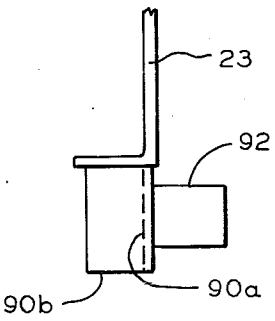
Figure 5B:
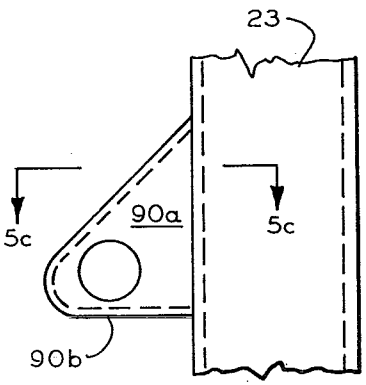
Figure 5A:
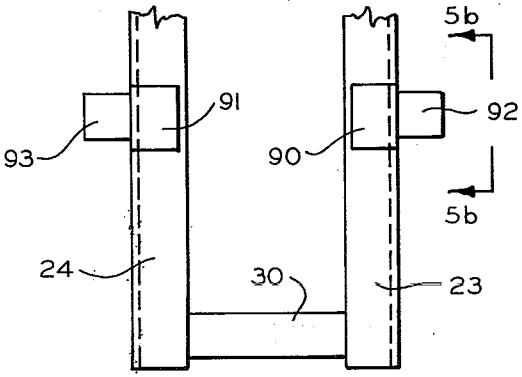

FIGS. 5*a*,5*b* and 5*c* are front, side and top views, respectively of portions of a mast used with one form of the present invention.

Figure 6A:
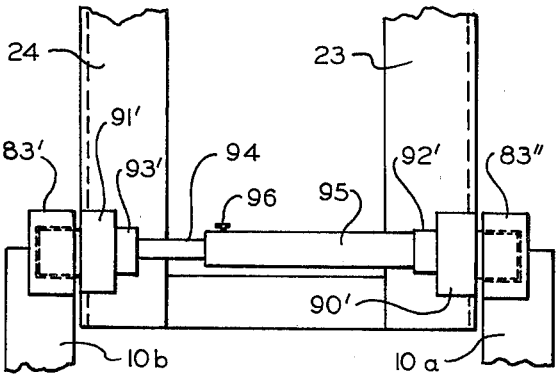

FIG. 6*a* illustrates portions of one modified form of mast-mounting arrangement according to the invention.

Figure 6B:
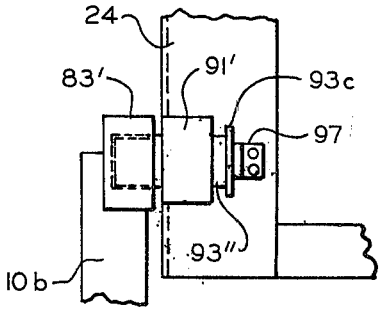

FIG. 6*b* illustrates portions of a further modified form of mast mounting arrangement.

The problems which arise when further mast sections or special load-carrying attachments must be installed in a given counterbalanced truck will become more clear from a consideration of FIGS. 1*a* to 1*d*. FIG. 1*a* is a diagrammatic side view of a truck which includes a base frame 10 having a pair of front load wheels 11, 12, only wheel 11 being visible in FIG. 1*a*, and one or more rear wheels 13. The truck mast 15 is mounted with its base at or very near the axle of the load wheels, and a load carriage 16 elevatable on mast 15 is shown carrying a load L on a fork device 17. An operator station and power compartment are carried on the base frame rearwardly of the mast. The center-of-gravity CG of load L is shown at a distance *a* from the load wheel axis, and thus the load imposes a clockwise moment of $a\ W_L$, where $W_L$ is the weight of load L. To prevent the truck from overturning, a counterclockwise moment exceeding $a\ W_L$ must be provided by the truck base frame and the equipment provided to the left of the load wheel axis in FIG. 1*a*, including counterweight CW. A primary object in lift truck design is to locate the load wheel axis as far forward as possible, i.e. as close to the load CG as possible, to minimize distance *a* as much as possible. The less the load moment $a\ W_L$, the smaller the counterbalancing moment need be, which has a doubling effect in reducing the weight and length of the vehicle. The absolute minimum moment arm distance *a* which one can provide is usually limited by the radius of the load wheels, since the load must clear the wheels. However, even that minimum distance is rarely achieved in practice. In most counterbalanced trucks a drive axle which extends between the two load wheels through a bulky differential gear housing occupies too much space to allow one to mount the mast as far rearwardly as one would desire, and one may not mount the mask in back of the axle since the load carriage then could not be fully lowered.

FIG. 1*b* shows the same basic truck as FIG. 1*a*, but with a load-rotating device 20 interposed between the carriage 16 and the load forks. Device 20 has a longitudinal thickness *b*, and thus the load CG is located distance $(a + b)$ from the load wheel axis in FIG. 1*b*. In order to compensate for the increased load moment arm, an additional counterweight CW2 is shown added to the rear of the prior art truck of FIG. 1*b*, Thus use of the device 20 disadvantageously not only adds its own weight, but requires the addition of counterweight CW2, and tends to increase the length of the truck at both ends.

FIG. 1*c* diagrammatically illustrates a typical prior art counterbalanced truck arrangement wherein the load carriage 16 is guided by the I-shape members 21, 22 of telescopic section of a conventional two-stage mast, with the telescopic section in turn being guided by a fixed upright mast section comprising a pair of channel members 23,24. The fixed upright members are shown pivotally fastened by brackets 25,26 on axle housing 27, which extends between the load wheels 11, 12 with differential gear housing 28 interposed between the wheels. If the load carriage 16 is mounted as far rearwardly as possible to decrease the load moment arm, it is apparent that very little space is available for the mast members, and for related parts (not shown) such as lift cylinders, hoist chains and the like. The fragmentary diagram of FIG. 1*d* indicates that when a third mast section which includes a further I-shape member 29 is added, the load moment arm is increased by distance *c* over that in FIG. 1*c*, which, of course, would also require either additional counterweighting or a de-rating of the truck.

In accordance with one concept of the present invention, the mast is arranged to be selectably positionable over a range of longitudinal positions in any one of a plurality of discrete longitudinal positions, in order that the mast may be located in a longitudinal position so as to compensate for the added longitudinal thickness of a special load-manipulating device, or the added truck length which use of an added mast section otherwise would require. The truck shown in FIG. 2*a* is shown including the same load rotating device 20 as that shown in FIG. 1*b*, but with the mast set back distance *b* from the position shown in FIG. 1*b*, so that the load moment arm in FIG. 2*a* is distance *a*, the same as in FIG. 1*a*. When different attachments or masts having different longitudinal dimensions are installed, the mast is set at different distances from the load wheel axis, thereby maintaining the load moment arm substantially constant.

In order to provide adequate space in which the mast may be adjustably shifted, the truck of the present invention dispenses with the conventional drive axle arrangement shown in FIG. 1*c*, and instead utilizes a configuration such as that shown diagrammatically in FIG. 2*b*. Each drive wheel is connected to be driven through a respective gear drive train, drive wheel 11 being shown driven from gearbox 41 and drive wheel 12 driven through gearbox 42. Gearboxes 41 and 42 are made adequately laterally thin (i.e. dimensions *g* in FIG. 2*b* are made small) in order to maximize the space (dimension *e* in FIG. 2*b*) available for mounting the mast. In typical applications of the invention, dimension *e* may be made approximately one-half dimension *d*, the width of the truck and dimension *f* may be made approximately one-half of dimension *e*. The creation of an opening of such size, to allow the mast to be selectably positioned while still providing effective power transmission to both wheels, is believed to be an outstanding feature of the invention.

To achieve the required opening for ample adjustment of the mast, it is desirable that no structural cross-tie members (other than parts of the mast itself) extend between the two gearboxes. Each gearbox is bolted to a rigid flange portion of the truck main frame, gearbox 41 being bolted to right-side frame member 10*a*, and gearbox 42 being bolted to leftside frame member 10*b*. The gearboxes are provided with substantially greater rigidity and torsional strength than ordinary gearboxes, for two reasons. Firstly, the location of the drive wheel axis y-y substantially forward from the ends of frame members 10*a* and 10*b* causes the weight of the truck and load to apply substantial bending forces to the gearboxes. Secondly, the gearboxes connect forces from the mast to the truck base frame.

One should particularly note in connection with FIG. 3*b*, the smallness of dimension *k*, the distance from the outside of wheel 12 to the inside of plate 44, and should further note that the width of wheel 12 itself is a large fraction of dimension *k*.

The two gearbox and wheel-mounting assemblies 41 and 42 each operate in identical fashion to each other and may be constructed identically except that one is a mirror-image of the other. As is seen in FIGS. 3*a*–3*c*, gearbox and wheel mounting assembly 42 includes a heavy outer casting member 43 the rear end of which is bolted to the forward end of side frame member 10*b* through bolt holes 43*a*, 43*b* (FIG. 3*a*), and an inner casting 44 which is fastened to member 43 by means of several dowel pins and a plurality of bolts shown at 44*a* in FIG. 3*a*. An input shaft 45 carrying a pulley 46 is driven through timing belt 47 (FIG. 3*a*) by motor M1 to provide a first speed reduction. Shaft 45 is journalled in members 43 and 44 (FIG. 3*b*) by means of bearings 48,49. Pinion gear 50 on shaft 45 drives idler gear 51 to provide a second gear reduction. Idler gear 51 is rotatably mounted by means of roller bearing 52 on stub shaft 53 which extends between members 43 and 44. Idler gear 51 in turn drives gear 54 mounted on shaft 55. The inner end of shaft 55 is rotatably mounted in member 44 by ball bearing 56. Shaft 56 is also rotatably mounted in member 43 by ball bearing 57, and the outer end of shaft 56 is formed with gear teeth to provide a pinion 58. Pinion 58 engages an internal ring gear 59 which is rigidly bolted to the felly 60 of drive wheel 12. Felly 60 is rotatably mounted on hub-like portion 43*a* of member 43 by means of roller bearings 61,62, It may be noted that gears 50, 51 and 54 all lie in the same plane, thereby minimizing the width of gearbox 42. The use of idler gear 51 serves to lengthen the drive train in a longitudinal sense, allowing the drive motor M1 and input shaft 45 to be spaced far enough behind the drive wheel axis of rotation *y—y* to provide adequate space on which the mast may be longitudinally adjusted. As seen in FIG. 3*b*, mating edge portions of members 43,44 engage each other, thereby to enclose gears 50,51 and 54, providing a chamber in which grease may be retained to lubricate the gear train.

In an exemplary embodiment of the invention, power was supplied to the input shaft of each gear box through a respective rubber timing belt, via timing pulley 46 in the case of gearbox 42. While shaft 45 is shown extending considerably rightwardly from plate 44 in FIG. 3*b*, thereby considerably increasing the width of that portion of the gearbox assembly, it is important to note that shaft 45 lies near the extreme inner end of assembly 42, inwardly beyond where any adjustment space for the mast was desired in the specific embodiment shown. In various embodiments of the invention, shaft 45 may be made much shorter, with its right end terminating in a bearing located within plate 44 at 49' and the tubular portion of casting 44 rightwardly therefrom omitted, with shaft 45 being driven from a pulley or gear carried on the other end of the shaft, where a brake is normally mounted.

In the specific embodiment being described, the gearbox power transmission arrangement required a rather limited rearward set-back of shaft 45 from the drive wheel axis *y—y* to accommodate a limited amount of longitudinal mast adjustment. In the application of this aspect of the invention to other trucks having longitudinally shiftable masts, it frequently may be desirable to provide even greater longitudinal distances between the wheel axis and the gear box input shaft, and in such cases we contemplate that one or more additional idler gears be interposed between shafts 45 and gear 54, in the same plane as gears 50,51 and 54. It will be apparent that power may be connected to the gearbox input shafts in a variety of different ways, such as by means of a chain or with gears, without departing from the invention. It is to be understood that rightside gearbox 41 is constructed generally similarly to assembly 42, to support and connect driving power to drive wheel 11. In typical applications a speed reduction of the order of 19.6 is desirable between the electric drive motor and its associated drive wheel. In the embodiment described, a first reduction by a factor of 1.83 was provided by use of a pulley on shaft 45 of 1.83 times the diameter of the motor drive shaft pulley, a second reduction by 3.1 was provided between pinion gear 50 and idler gear 51, idler gear 51 and gear 54 rotated at the same speed, and further reduction by a factor of 3.4 was provided between pinion 58 and internal ring gear 59.

In order to be able to adequately adjust the longitudinal position of the mast to accomodate or compensate for the inclusion of a variety of different load-handling attachments and mast configurations, typical applications require that the mast be adjustable over a range of say 6 to 7 inches, in increments of approximately 1 inch. It is also highly desirable that the adjustment be of a type which can be readily made in the field by unskilled persons, although it is expected that the main advantages of the invention will accrue in the factory, since a single truck design then will be able to accommodate a variety of load-handling attachments and different mast thicknesses.

As shown in FIGS. 3*a* and 3*c*, the top of gearbox 42 has a seat provided with three machined surfaces which may serve to locate and retain a mast mounting block assembly (not shown in FIG. 3*a*). A horizontal surface 70*a* receives the main vertical load transmitted from the most through the mounting block. A vertical laterally-extending surface 71*a* forming the rear of the seat resists horizontal loads communicated through the mast to the truck, and serves as a reference surface relative to which the longitudinal position of the mast may be spaced. A vertical longitudinally extending surface 72*a* of the seat serves as a flange for bolting a mast mounting block assembly. In FIG. 3*a* six threaded bolt holes 73*a*–73*f* are shown provided in surface 72*a* of member 43. It is to be understood that gearbox 41 is provided with a similar three-surface seat, including a horizontal surface 70*b* at the same level as surface 70*a*, a vertical transversely-extending surface 71*b* located at the same longitudinal position as surface 71*a*, and a vertical longitudinally-extending surface 72*b* located at the same level as surface 72*a*.

FIGS. 4*a* and 4*b* illustrate an exemplary form of mast mounting-block assembly 80 one of which is mounted atop leftside gearbox 42 and another of which is mounted atop rightside gearbox 41. The assembly will be seen to comprise an upper plate 81 and a lower plate 82. A pair of holes 83*a*,83*b* extending vertically through upper plate 81 register with threaded holes 84*a*,84*b* in lower plate 82, so that a pair of bolts (not shown) may securely affix plate 81 to lower plate 82. The upper ends of holes 83*a*,83*b* are shown counterbored so that the bolt heads may be recessed, although that is not absolutely necessary. The block assembly 80 will be seen to include a plurality (three are shown) of large cylindrical bores 85*a*–85*c* centered along the line joining plates 81,82, so that half of each bore is located in upper plate 81 and the other half in lower plate 82. Bores 85*a*–85*c* are shown in FIG. 4*b* as extending horizontally entirely through the block assembly, although, as seen below, that is not absolutely necessary. In FIG. 4*a* the diameter of each of bores 85*a*–85*c* is shown slightly less than the spacing between adjacent bores. Upon the drilling of such bores they would not communicate with each other as shown. In FIG. 4*a* the thin section of metal which would remain between adjacent bores is shown cutaway for a reason to be mentioned below, although again, that is not absolutely necessary.

A plurality (three are shown) of smaller mounting holes 86*a*–86*c* are shown extending horizontally through lower plate 82. In FIG. 4*b* each of these mounting holes are shown counterbored at both ends. While such an arrangement may be used, we prefer to provide mounting holes 86*a*–86*c* which are counterbored at one end only, as at *a'*, *b'*, and *c'* for one mounting-block assembly to be used with a given truck, and at the other end only, as at *d'*, *e'*, *f'* for the other mounting-block assembly to be used with the truck. Counterboring such holes at one end rather than both ends serves to strengthen each assembly. In the ensuing discussion of FIGS. 4*c* and 4*d*, a mounting block assembly having its mounting holes counterbored at *a'*, *b'* and *c'* will be designated as the 80*b* mounting block, and an assembly having its mounting holes counterbored at *d'*, *e'* and *f'* will be designated as the 80*a* mounting block.

One end of each of plates 81,82 is machined to provide a flat vertical surface S at one end of the mounting block, and the other end of each plate machined to provide a flat surface L. It is important to note, in order to appreciate another feature of the invention, that although the large cylindrical bores 85*a*–85*c* are shown spaced from each other on regular centers (distance *b* in FIG. 4*a*), the center of the plurality of bores is offset from the center of the assembly, i.e. the center of bore 85*a* is distance *c* from end face S of the assembly but end face L is a greater distance *a* from the center of bore 85*c*. For sake of convenience, the end of the mounting block adjacent face S may be termed the short end of the mounting block assembly, and the end adjacent face L may be termed the long end of the assembly. In FIG. 4*c* a pair of mounting blocks 80*a*,80*b* are diagrammatically shown arranged with their faces L abutting the vertical reference surface 71*a* on gearbox 41 and the counterpart surface 71*b* on gearbox 42. With such an arrangement, it will be seen that the centers of the three large bores in each of the blocks will be located forwardly of the reference plane of surfaces 71*a*, 71*b* by amounts a, $(a + b)$, and $(a + 2b)$, respectively, as are shown by dimensions at 90 in FIG. 4c. Assuming values of 3.5 and 2.5 inches for distances *a* and *b*, the centers of the bores will be located 3.50, 6.00 and 8.50 inches from reference plane 71. In FIG. 4*d* the same pair of mounting blocks are shown interchanged, with block 80*a* now positioned atop gearbox 42, and with the faces S at the short ends of the blocks abutting reference surfaces 71*a*, 71*b*, so that the centers of the three large bores in each of the blocks now are located forwardly of the reference plane 71 by amounts c, $(c + b)$ and $(c + 2b)$, respectively, as is indicated by the dimensions at 90 in FIG. 4*d*. Assuming distance *c* equals 2.25 inches, the centers of the bores will be located 2.25, 4.75, and 7.25 inches from reference plane 71. Thus by rotating the blocks, a total of six different mast positions may be achieved even though each block contains only three bores. With the values suggested, the available mast positions from the reference plane 71 will be seen to increase in equal increments of 1.25 inch. It will be seen that equal angular increments will result if the difference between distances *a* and *c* equals one-half distance *b*.

In FIGS. 4*a* and 4*b* mounting holes 86*a*–86*c* are shown spaced apart from each other with the same spacing (distance *b*) as that between bores 85*a*–85*c*, but with the mounting holes staggered or longitudinally offset by one-half distance *b* from the centers of the bores. Such an arrangement will be seen to strengthen the mounting blocks by providing maximum metal between each mounting hole and the adjacent bores for a lower plate 82 of given thickness (height). It will be apparent, however, that other mounting hole spacings could be used, if desired, with the holes 86*a*–86*c* centered relative to the bores 85*a*–85*c*, for example, if the thickness of each plate 82 were increased.

In both FIGS. 4*c* and 4*d* the distances of the mounting block mounting holes from the reference plane are indicated at 91. With the mounting hole arrangement shown in FIGS. 4*a* and 4*b*, installation of mounting blocks 80*a* and 80*b* in the manner indicated in FIG. 4*c* causes mounting holes 86*a*–86*c* in block 80*b* to lie forward of reference surface 71 by distances of *c*, $(c + b)$, and $(c + 2b)$, so that holes 86*a*–86*c* in block 80*b* register with mounting holes *a*, *c*, and *e* in member 43 of gearbox 42, while the mounting holes in block 80*a* lie similar distances forward from reference plane 71. With the mounting blocks interchanged, as in FIG. 4*d*, it will be seen that the mounting holes 86*a*–86*c* in block 80*a* will register with holes *b*, *d*, and *f* in member 43 of gearbox 42, with the mounting holes in block 80*b* lying similar distances from plane 71.

In FIG. 5*a* the lower portion of the fixed upright mast section is shown as comprising a pair of inwardly-facing channel members 23,24 interconnected by a cross-brace member 30. Brackets 90 and 91 welded to the rear flanges of channels 23 and 24 carry respective outwardly extending stub shafts 92,93. As seen in FIGS. 5*b* and 5*c* each bracket may comprise a generally triangular plate 90*a* welded to the rear flange of a channel, preferably aligned with the web of the channel, and a stiffener strap 90*b* welded along the outer edges of the plate and welded to the channel. The inner end of the stub shaft is welded to the triangular plate. Various other types of brackets may be used, of course, to mount a pair of stub shafts in equivalent fashion.

In order to mount the mast in a selected longitudinal position, the two bolts are removed from each mounting block assembly, to allow the upper plate 81 of each assembly to be removed, and then the mast is simply lowered in place, with stub shafts 92,93 engaging a selected pair of the large semi-cylindrical bores in the lower plates 82 of the assemblies. The mast ordinarily will be lowered slowly while supported by an overhead crane or another lift truck. If very thin metal sections existed between adjacent bores in the mounting blocks, they could be bent by the stub shafts of the mast unless the mast were lowered with great care, and hence the thin sections are preferably removed, as shown in FIG. 4*a*. In embodiments of the invention where adjacent bores in the mounting blocks are spaced substantially further apart than the bore diameter, it will be apparent that adjacent bores may be completely cylindrical and need not communicate with each other. With the stub shafts 92, 93 of the mast situated in a selected pair of the large circular holes of the mounting blocks, it will be apparent that the mast may be readily tilted about the axis of the stub shafts. A conventional hydraulic tilt cylinder mechanism 30 (FIG. 2*a*) may extend between the mast and the truck frame to tilt the mast. The truck frame is preferably provided with a pair of longitudinal rows of spaced mounting holes (not shown) so that the cylinder mechanism 30 may be bolted to the truck frame at different longitudinal positions when the mast is situated at different longitudinal positions. Alternatively, the tilt mechanism 30 itself may be made adjustable in length.

FIG. 6*a* illustrates in rear elevation an alternative form of mast mounting arrangement wherein stub shafts 92' and 93' are not welded to support brackets 91' and 92' on the rear of the mast, but instead rotatably journalled therein. Rod 94 welded to stub shaft 93' may telescope into hollow pipe 95 which is welded to stub shaft 92'. Set screw 96 normally holds rod 94 and pipe 95 in a fixed telescopic position, thereby retaining stub shafts 92', 93' in selected bores in mounting blocks 83' and 83''. When it is desired to change the mast position, one need merely loosen set screw 96 and pull the stub shafts inwardly, withdrawing them from mounting blocks 83' and 83'', so that they then may be re-inserted in a different pair of bores in the mounting blocks. This arrangement has the advantage that no bolts have to be removed and replaced, and that the mounting blocks do not have to be split, and hence may be stronger. The mounting blocks 83' and 83'' may be interchangeable or reversible, in same manner as the previously described mounting blocks, in order to increase the number of available mast positions one may obtain with a given pair of mounting blocks.

FIG. 6*b* illustrates in rear elevation a portion of a further alternative form of mast mounting arrangement. The mounting of only one side of the mast is shown, and it will be recognized that the other side of the mast may be mounted similarly. Stub shaft 93'' is rotatably journalled in and extends through bracket 91' welded to the rear of the mast member 24 and extends into mounting block 83', which need not be split. A small angle piece 97 bolted to the mast member 24 normally retains stub shaft 93'' in position in bracket 91' and the mounting block, and merely unbolting piece 97 allows one to remove the stub shaft to move the mast to a different position. A flange 93*c* is provided on the inner end of shaft 93'' to facilitate removal of the shaft with a crowbar or like tool.

While the gearbox arrangement shown will normally apply to trucks wherein the wheels adjacent the mast end of the truck are driven wheels, some concepts of the invention may be applied to trucks which use free-rolling load wheels at the mast end of the truck and one or more drive wheels at the opposite end of the vehicle. For example, the mounting block assemblies with plural bores to accommodate stub shafts on the mast might be used in a variety of different types of trucks.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

We claim:

1. A lift truck, comprising, in combination: a base frame having a forward edge; a pair of rigid housings affixed to said base frame and extending forwardly therefrom at opposite sides of said base frame, thereby providing a space between said housings; a pair of drive wheels journalled in respective ones of said rigid housings on an axis near the forward ends of said rigid housings; a pair of motors mounted on said base frame rearwardly from said forward edge of said base frame and connected by flexible power-transmission means to respective ones of said housings near the rearward ends of said housings; a respective plurality of gear means inside each of said housings for connecting said drive wheels to said motors; a vertically-extending mast assembly carrying a load carriage; a load-engaging means carried on said load carriage to support a load forwardly from the axis of said drive wheels; a pair of mounting blocks, each of said mounting blocks being located above and fixedly secured to the top of a respective one of said housings, each of said mounting blocks having a plurality of longitudinally-spaced bores, said mast assembly including a pair of laterally-extending stub shaft members mounted near its lower end, said stub shaft members being adapted to pivotally seat within selected pairs of said bores further the top of each of said housings is provided with a seat having three mutually-perpendicular surfaces, each of said mounting blocks being adapted to be bolted atop a respective one of said housings to engage the three surfaces of said housing.

2. A truck according to claim 1 which includes ram means connected to said mast assembly to pivot said mast assembly about an axis defined by the selected pair of said bores.

3. A truck according to claim 1 wherein each of said mounting blocks is split into upper and lower pieces along a plane through the centers of its respective bores and includes bolt means for bolting its respective upper and lower pieces together.

4. A truck according to claim 1 wherein each of said housings includes a vertical reference surface situated a predetermined distance forwardly from said edge of said base frame, an end of each of said mounting blocks being adapted to be fixed in position against the reference surface of a respective one of said housings, and wherein the two ends of each of said mounting blocks are located different distances from the endmost bores of said mounting blocks, whereby the available longitudinal distances of said bores from said reference surfaces may be doubled by interchanging said mounting blocks between said housings.

5. A truck according to claim 1 wherein said mast assembly comprises a pair of laterally-spaced vertically-extending structural members each carrying a through journal bore near its lower end, said stub shaft members slidably extending through respective ones of said journal bores into said selected pair of said bores in said mounting blocks, and means for blocking lateral movement of said stub shaft members to retain said stub shaft members in said selected pair of bores.

6. A truck according to claim 5 wherein said means for blocking comprises telescoping shaft means extending between said stub shaft members.

7. A truck according to claim 5 wherein said means for blocking comprises a pair of removable stop means affixed to respective ones of said structural members.

8. A truck according to claim 1 wherein said mast assembly comprises a pair of laterally-spaced vertically-extending structural members, said stub shaft members being rigidly affixed to said structural members.

9. A truck according to claim 1 wherein all of each of said bores in said mounting blocks is located above the level of said axis of said drive wheels.

10. A truck according to claim 1 wherein at least one of the bores in each of said mounting blocks is located rearwardly from said axis of said drive wheels.

11. A truck according to claim 1 wherein an inner face of each of said drive wheels is located closely adjacent an outer side of a respective one of said rigid housings.

12. A truck according to claim 1 wherein each of said rigid housings includes a plate member having an elongated recess on its inner side and a hub extending from its outer side to rotatably support a respective one of said drive wheels, an input shaft journalled in said plate member and extending into said recess to support a first pinion within said recess, an output shaft journalled in said plate member rearwardly from the axis of said hub, said output shaft carrying a first gear within said recess and extending outwardly from said plate member to support a second pinion on the outer side of said plate member, and further gear means journalled in said member and situated in said recess to mesh with said first pinion and said first gear, each of said drive wheels having an internal ring gear meshing with the second pinion in a respective one of said housings.

13. An arrangement according to claim 12 wherein said further gear means comprises a single gear.

14. An arrangement according to claim 12 wherein said further gear means comprises a plurality of gears.

15. An arrangement according to claim 12 wherein the axes of said input and output shafts and of said hub are mutually parallel.

16. An arrangement according to claim 12 having a cover plate member attached to the inner side of each plate member to cover the recess therein and wherein the input shaft, output shaft and further gear means in each recess are also journalled in the cover plate member covering the recess.

17. An arrangement according to claim 12 wherein said hub extends outwardly from said plate member for a distance exceeding three times the depth of said recess.

18. An arrangement according to claim 12 wherein said first pinion, said first gear and said further gear means all lie within the same plane within said recess.

* * * * *